United States Patent [19]

Bracegirdle

[11] Patent Number: 4,913,552

[45] Date of Patent: Apr. 3, 1990

[54] COUNTERCURRENT DRUM MIXER

[76] Inventor: Paul E. Bracegirdle, 559 Fairman La., Langhorne, Pa. 19047

[21] Appl. No.: 401,995

[22] Filed: Sep. 1, 1989

[51] Int. Cl.[4] ..... B28C 5/46; B28C 1/22

[52] U.S. Cl. ..... 366/4; 366/15; 366/25; 366/40; 432/14; 432/105

[58] Field of Search ..... 366/4, 5, 6, 7,.11, 366/40, 12, 14, 15, 22–24, 25, 54, 56–58, 68, 225, 228; 432/72, 14, 73, 19, 105, 111, 114

[56] References Cited

U.S. PATENT DOCUMENTS

| | | | |
|---|---|---|---|
| 3,542,348 | 11/1970 | Hoffnungsthal et al. | 432/105 |
| 4,075,710 | 2/1978 | Jakob et al. | 366/25 |
| 4,229,109 | 10/1980 | Benson | 366/24 |
| 4,309,113 | 1/1982 | Mendenhall | 366/4 |
| 4,398,826 | 8/1983 | Mendenhall | 366/228 |
| 4,427,376 | 1/1984 | Etnyre et al. | 432/105 |
| 4,462,690 | 7/1984 | Wirtgen | 366/25 |
| 4,522,498 | 6/1985 | Mendenhall | 366/4 |
| 4,787,938 | 11/1988 | Hawkins | 432/14 |

*Primary Examiner*—Timothy F. Simone
*Attorney, Agent, or Firm*—Dunlap, Codding, Peterson and Lee

[57] ABSTRACT

A drum mixer having an countercurrent flow drying zone and a parallel flow mixing zone is provided for producing an asphaltic composition. The drum mixer utilizes a heat source located at an intermediate position therein for generating three streams of hot gases. The first stream of hot gases is directed towards the receiving end of the drum mixer in a countercurrent direction to the flow virgin aggregate entering the drying zone of the drum mixer. Recycle material is introduced into the drum mixer between the heat source and the discharge end thereof. The recycle material and the heated virgin aggregate are combined within the mixing zone. As both materials travel towards the discharge end of the drum mixer the second stream of hot gases is directed towards the discharge end of the drum mixer in a parallel direction to the flow of the mixing materials for heating said materials. Liquid asphalt is mixed with the virgin aggregate and the recycle material in the mixing zone and the resulting asphaltic product is removed from the drum mixer at the discharge end. As the second stream of hot gases exits the discharge end of the drum, the flow of the second stream of hot gases is reversed creating a third stream of hot gases. The third stream of hot gases is returned to the heat source within the drum for burning hydrocarbon by-products produce during the operation of the drum mixer.

32 Claims, 3 Drawing Sheets

COUNTERCURRENT DRUM MIXER

BRIEF SUMMARY OF THE INVENTION

1. Field of Invention

The present invention relates generally to drum mixers used for producing an asphaltic composition.

2. Background of the Invention

In the present state of the art of making hot mix asphalt in a drum mixer type plant wherein a portion of the materials used in making the composition comprises recycle asphalt, there are basically two types of drums; a parallel-flow drum and a counter-flow drum.

A parallel-flow drum is represented by U.S. Pat. Nos. Re. 31,904 and Re. 31,905. In such a parallel-flow drum, the burner is located at the higher, input end of the drum where virgin aggregate is introduced, such that the virgin aggregate flow is parallel with the flow of the hot gases of combustion. Recycle material is introduced at a cooler zone of the drum and flows, along with the hot virgin aggregate, parallel to the flow of the hot gases of combustion, such that the recycle material is heated both by contact with the hot virgin aggregate and the gases of combustion.

A counter-flow drum is represented by U.S. Pat. No. 4,787,938. In this type of drum, the burner is located at an intermediate point in the drum with the hot gases of combustion flowing toward the higher, input end of the drum where the virgin aggregate is introduced. Thus, the virgin aggregate and hot gases of combustion are in a counter-flowing relation. The recycle material is introduced into the drum downstream from the burner, with the hot virgin aggregate and the recycle material being mixed in the drum downstream from the burner. In this type of drum, the recycle material is heated solely, or almost solely, by contact with the hot virgin aggregate. A similar process is carried out in what is known in the art as a double barrel arrangement where the hot virgin aggregate is discharged from the lower end of a rotation drum outwardly into a housing surrounding portion of the drum and the recycle material is introduced into the housing around the rotating drum for mixture with the hot virgin aggregate. Here again, the recycle material is heated almost solely by the hot virgin aggregate.

In the present invention, the burner is located at an intermediate position in the drum to direct a flow of hot combustion gases toward the upper, input end of the drum where the virgin aggregate is introduced, such that the flow of combustion gases and aggregate in this portion of the drum are countercurrent. The recycle material is introduced downstream from the burner and is mixed with the hot virgin aggregate in the downstream end portion of the drum and the recycle material is heated by contact with the hot virgin aggregate. Means are also provided for directing a portion of the hot combustion gases through the downstream end portion of the drum in a flow pattern parallel with the recycle material and virgin aggregate being mixed, such that the recycle material is also heated by hot gases of combustion.

BRIEF DESCRIPTION OF THE DRAWINGS

FIG. 3 is a semi-schematic vertical cross-sectional view of a second modified drum mixer.

DESCRIPTION OF THE PREFERRED EMBODIMENTS

Figure 1:
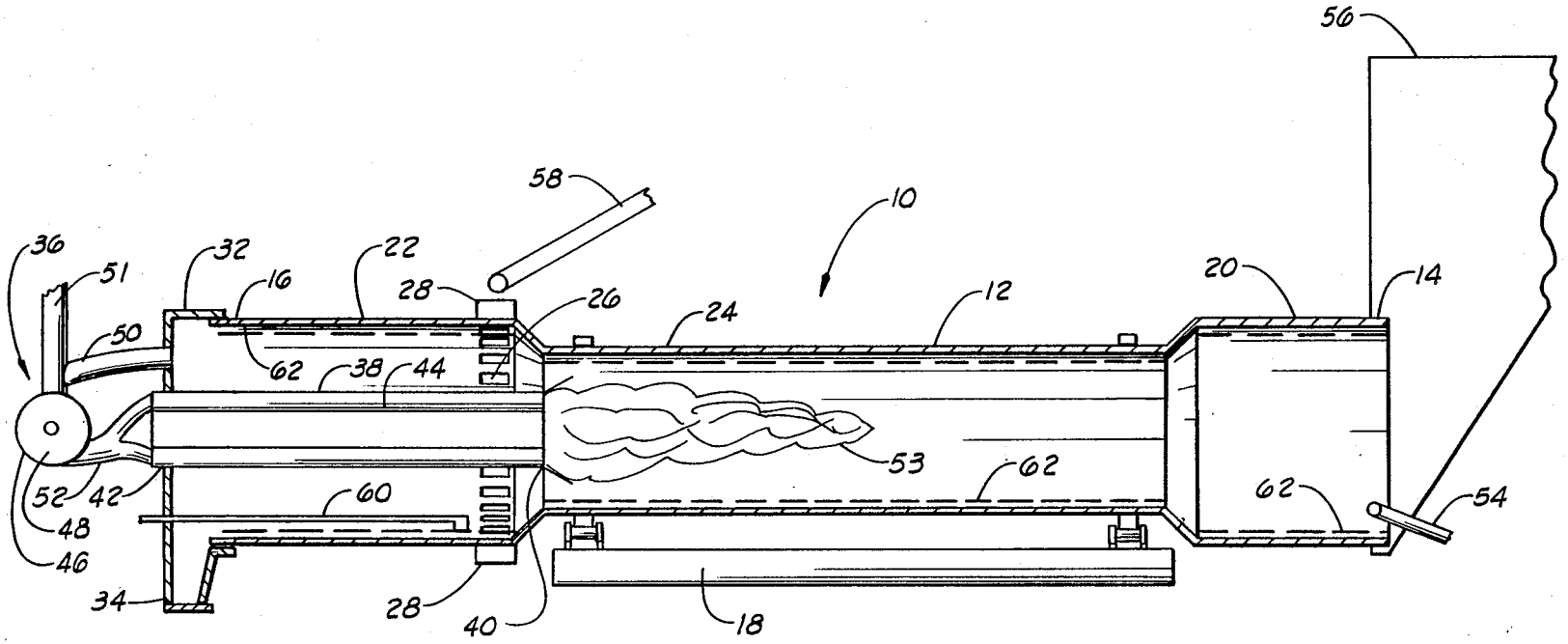
FIG. 1 is a semi-schematic vertical cross-sectional view of a drum mixer constructed in accordance with the present invention.

As shown in FIG. 1, the present invention comprises a drum mixer designated generally by the reference numeral 10. The drum mixer 10 includes a drum 12 having a first end 14 and a second end 16. It Will be understood that the drum 12 is positioned in a slightly inclined position wherein the level of the first end 14 is above the level of the second end 16. It will be further understood that the drum 12 may be supported in this position by a conventional support system 18 and rotated by a conventional drive system (not shown).

The drum 12 is further characterized by expanded portions 20 and 22, extending from the first end 14 and the second end 16 respectively, and a smaller diameter intermediate portion 24. Portions 20 and 24 function as what will be called the drying zone within the drum 12 and portion 22 functions as what will be called the mixing zone within the drum mixer 10.

The expanded portion 22 includes a first ring of rectangular material ports 26 therein, adjacent the between the expanded portion 22 and the smaller diameter portion 24. A material entry collar 28 overlays the material ports 26. The drum mixer 10 also includes a cylindrically shaped stationary collar 32 positioned at the second end 16 of the drum 12. Portions of the collar 32 overly the second end 16 of the drum 12 such that the second end 16 may freely rotate within the collar 32. A discharge structure 34 extends from the collar 32 adjacent the second end 16 of drum 12.

The drum mixer 10 has a burner assembly 36 positioned generally at the second end 16 of the drum 12. The burner assembly 36 includes a secondary air tube 38, having a first end or burner head 40 extending into the drum 12 and a second end 42 secured to the collar 32, and a fuel line 44 extending substantially the length of the secondary air tube 38. The secondary air tube 38 is of sufficient length such that the first end 40 is positioned at an intermediate location in the drum 12 substantially at the transition between the expanded portion 22 and the smaller diameter portion 24.

The burner assembly 36 further includes a combustion gas circulation system 46. The combustion gas circulation system 46 includes a blower 48, an intake duct 50 extending from the collar 32 to an ambient air duct 51, the ambient air duct 51, opened at one end, extends between the intake duct 50 and the blower 48, and an exhaust duct 52 extending from the blower 48 to the secondary air tube 38.

In operation, the blower generates an area of reduced pressure in the expanded portion 22 by evacuating the gases within the expanded portion 22 through the intake duct 50. A volume of combustible gases is produced within the blower 48 by blending the gases evacuated from the expanded portion 22 through duct 50 with ambient air entering the blower 48 through the duct 51. The blower 48 pressurizes the combustible gases and directs said gases into the duct 52, said gases exiting the secondary air tube 38 at the burner head 40. The ignition of the combustible gases with a suitable burner fuel at the burner head 40 creates a flame 53, which generates a volume of heated gases.

The volume of heated gases are segregated into a first stream of hot gases, a second stream of hot gases and a third stream of hot gases. The first stream of hot gases is directed towards the first end 14 of the drum 12.

As the gases within the expanded portion 22 are evacuated therefrom by the blower 48, a portion of the hot gases exiting the burner is drawn into the expanded portion 22, thus creating the second stream of hot gases. The second stream of hot gases is directed towards the second end 16 of the drum 12 and enters the blower 48 via the duct 50. The blower 48 reverses the directional flow of the second stream of hot gases exiting the drum 12 and creates a third stream of hot gases which is combined with ambient air, pressurized and returned to the drum 12 through the secondary air tube 38.

The drum mixer 10 further includes a conveyor 54 at the first end 14, for introducing a first volume of material (virgin aggregate) in to the drum 12 and a conventional exhaust collection system 56. The exhaust system 56 is sized for overlying the first end 14 of the drum 12.

The drum mixer 10 further includes a conveyor 58 for introducing a second volume of material (recycle asphalt material) into the drum 12 through the material entry collar 28. It is understood that the second volume of material may also consist of virgin aggregate. Additionally, the drum mixer includes a liquid asphalt injection tube 60 and a plurality of mixing flights 62.

In accordance with the present invention, the method for continuously producing an asphaltic composition preferably is carried out by rotating the drum 12 and introducing virgin aggregate into the drying zone, portions 20 and 24, of the drum 12 through the first end 14 thereof. As the virgin aggregate flows from the first end 14 of the drum 12 towards the second end 16 of the drum 12 it is lifted by the flights 62 such that curtains of falling material are created within the drum 12.

The virgin aggregate is heated within the drum mixer 10 by the first stream of hot gases flowing from the burner head 40 towards the first end 14 of the drum 12. In this way, the hot gases produced by the flame 53 flow in a countercurrent direction to the flow of virgin aggregate within the drum mixer 10. Recycle material is introduced into the drum 12 through the material entry collar 28 and is mixed with the heated virgin aggregate material in the mixing zone, portion 22, of the drum 12. The mixing materials flow within the mixing zone from the material entry collar 28 towards the second end 16 of the drum 12. As the mixing materials progress towards the second end 16 of the drum 12, they are lifted by the flights 62 such that curtains of falling materials are created within the expanded portion 22.

In addition to the transfer of heat by conduction from the hot virgin aggregate to the cooler recycle material, the mixing materials are further heated within the mixing zone by the second stream of hot gases. The second stream of hot gases originates in an area adjacent the burner head 40 and flows towards the second end 16 of the drum 12. In this way, the second stream of hot gases flows in a parallel direction to the flow of mixing materials within the mixing zone. Further, any combustible materials, such as hydrocarbon vapors created in the mixing zone 22 will be circulated back to the burner and burned.

It is understood that, depending upon the composition of the material entering the drum 12 through the material entry collar 28, a certain quantity of liquid asphalt sufficient to produce an asphaltic composition will be injected into the mixing zone through the tube 60. The liquid asphalt is combined with the mixing materials to produce the desired asphaltic composition. The asphaltic composition is discharged from the second end 16 of the drum 12 through the discharge structure 34. It will be understood that continuous quantities of the above materials may be introduced into the drum mixer 10 such that a continuous discharge of asphaltic composition is produced.

Figure 2:
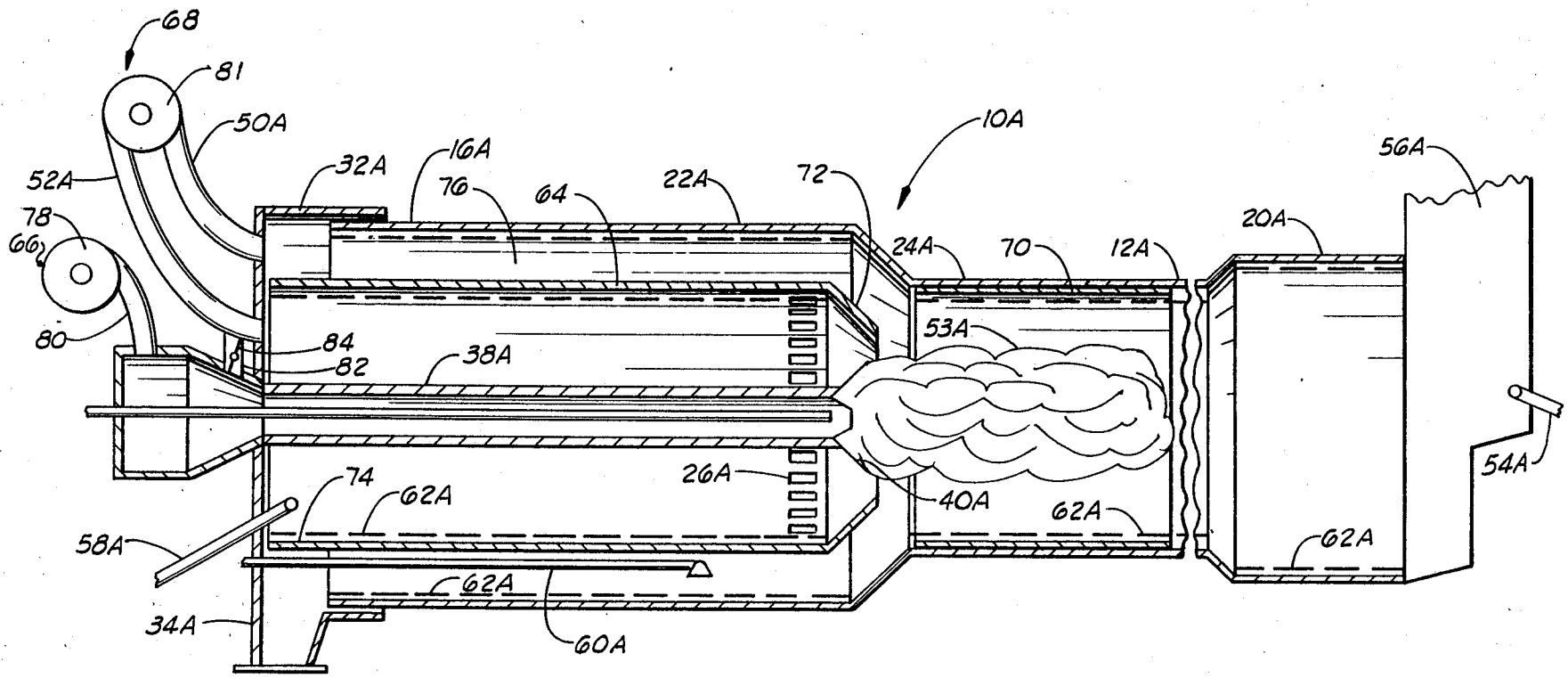
FIG. 2 is a semi-schematic vertical cross-sectional view of a first modified drum mixer.
Figure 9:
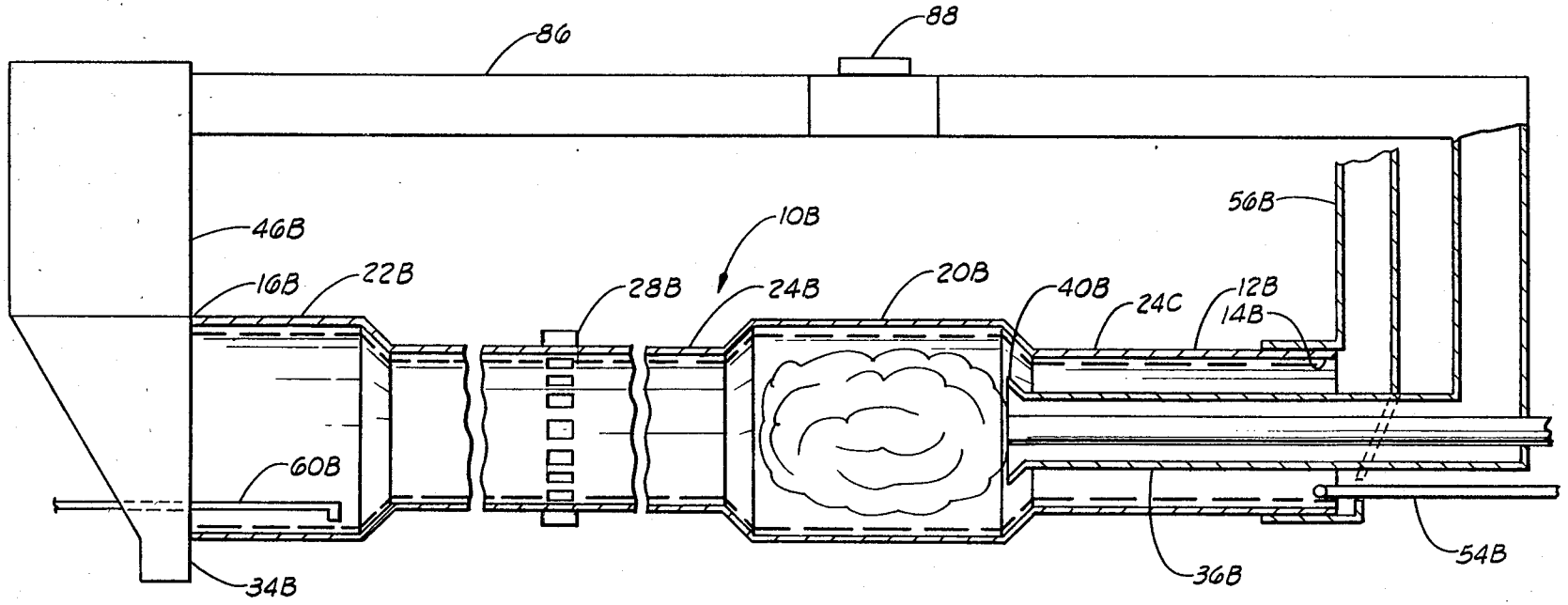

As shown in FIG. 2, the drum mixer a is similar to the drum mixer 10 shown in FIG. 1, except that basically, drum mixer a includes a second rotating drum 64 disposed within the expanded portion 22A of the first drum 12A, a blower assembly 66 and a combustion gas circulation system 68. The drum mixer a further includes a combustion zone liner 70.

The second drum 64 includes a first end 72 adjacent the burner head 40A and a second end 74 adjacent the collar 32A. The diameter of the second drum 64 is sized such that an annulus 76 is created between the expanded portion 22A of the first drum 12A and the second drum 64. The drum mixer 10A also includes a plurality of mixing flights 62A.

The blower assembly 66 includes a blower 78 and a duct 80 for directing combustion air into the tube 38A. The combustion gas circulation system 68 includes a blower 81, an intake duct 50A connected between the collar 32A, adjacent the annulus 76, and the blower 81 and an exhaust duct 52A connected between the blower 81 and the collar 32A, adjacent the second end 74 of the second drum 64. The combustion gas circulation system 68 operates in a similar manner as the combustion gas circulation system 46 except that the third stream of hot gases generated by the combustion gas circulation system 68 is directed into the second drum 64, through the duct 52A, for heating the materials therein rather than into the tube 38A.

As shown in FIG. 2, the drum mixer 10A also includes a duct 82 connecting the tube 38A with the exhaust duct 52A. The duct 82 has a valve 84 for movement between an open position and a closed position. When the valve 84 is in the closed position, recirculating combustion gases are segregated from the combustible gases entering the tube 38A. Conversely, when the valve 84 is in the open position, recirculating combustion gases may be mixed with combustion air entering the tube 38A.

Drum mixer 10A operates similar to drum mixer 10 except that the second volume of material, preferably recycle material, is introduced into the second end 74 of the second drum 64 by the conveyor 58A. It is further understood that, as above, the second volume of material may also be virgin aggregate.

The recycle material entering the second drum 64 travels towards the first end 72 in a parallel direction with respect to the third stream of hot gases entering the second drum 64 through the exhaust duct 52A. As the recycle material progresses towards the first end 72 of the second drum 64, it is heated by the third stream of hot gases and lifted by the flights 62A such that curtains of falling material are created therein. The recycle material is discharged from the second drum 64 through a plurality of material ports 26A into the annulus 76 adjacent the transition between the expanded portion 22A and the smaller diameter portion 24A. As the recycle material enters the annulus 76, it is mixed with the heated first volume of material. In addition to the transfer of heat from the hot virgin aggregate to the cooler recycle material, the mixture is further heated by the second stream of hot gases traveling parallel to the flow of the mixture within the annulus 76. As the mixture travels within the annulus, it is lifted by the flights 62A such that curtains of falling material are created therein.

As the mixture progresses towards the second end 16A of the first drum 12A a volume of liquid asphalt is added thereto through the injection tube 60A. The asphaltic composition produced is discharged from the first drum 12A through the discharge structure 34A. In the drum mixer 10A previously described, any combustible materials created or released in the annular mixing chamber 76 are re-circulated back to the burner and burned.

A drum mixer 10B, illustrated in FIG. 3, is substantially similar in structure and in operation to the drum mixer 10 shown in FIG. 1 except that the expanded portion 20B of the drum mixer 10B is located between two smaller diameter portions 24B and 24C, and the burner assembly 36B of the drum mixer 10B is positioned at the first end 14B thereof. The burner assembly 36B extends into the drum 12B from the first end 14B to a point substantially adjacent the transition between the smaller diameter portion 24C and the expanded portion 20B.

The first stream of hot gases is generated by a fan (not shown) in the exhaust system 56B. The fan creates an area of reduced pressure in the smaller diameter portion 24 by evacuating the gases therefrom. A portion of the hot gases exiting the burner head 40B is drawn into the smaller diameter portion 24C and flows towards the first end 14B creating the first stream of hot gases. Thus, the first stream of hot gases within the drum 12B flows from the burner head 40B towards the first end 14B in a direction countercurrent to the flow of the first volume of material entering the drum 12B via the conveyor 54B.

The second volume of material, preferably recycle material, enters the drum 12B through the material entry collar 28B positioned in the smaller diameter portion 24B and combines with the first volume of material. The mixing first and second volumes of material flow towards the second end 16B where liquid asphalt may be added to the mixing materials in the expanded portion 22B throught the liquid asphalt pipe 60B. The final porduct exits the drum 12A through the discharge structure 34B. As above, the second volume of material may also be virgin aggregate.

The second stream of hot gases flows from the burner head 40B to the second end 16B of the drum 12B. In this way, the second stream of hot gases flows parallel to the flow of the first volume of material between the burner head 40B and the collar 28B and parallel to the flow of the mixing first and second volumes of material between the collar 28B and the second end 16B.

The second stream of hot gases is captured at the second end 16B by the combustion gas circulation system 46B. The directional flow of the second stream of hot gases is reversed in a duct 86 of the combustion gas circulation system 46B creating the third stream of hot gases. A fan 88 is provided at an intermediate location in the duct 86 for urging the third stream of hot gases towards the first end 14B of the drum 12B where said stream is circulated into the burner assembly 36B. In this way, combustible material created or released during the operation of the drum mixer 10B will be circulated into the burner assembly 36B and burned.

Changes may be made in the construction, operation, and arrangement of the various parts, elements, steps, and procedures described herein without departing from the spirit and scope of the invention as defined in the following claims.

I claim:

1. In a method for continuously producing an asphaltic composition comprising the steps of:

introducing a first volume of material into an inclined, rotating drum at a first end to flow generally from the first end to a second end of the drum:

creating a flame at an intermediate location in the drum and directing a first stream of hot gases produced thereby to flow towards the first end of the drum in countercurrent relation to the flow of the first volume of material for heating the first volume of material;

introducing a second volume of material into the drum between the flame and the second end of the drum to flow generally towards the second end of the drum;

mixing the heated first volume of material with the second volume of material between the flame and the second end of the drum;

directing a second stream of hot gases produced by the flame to flow towards the second end of the drum in parallel relation to the flow of the mixing materials for heating the mixing materials; and discharging the asphaltic composition from the second end of the drum.

2. The method of claim 1 including the step of mixing liquid asphalt with the mixing first and second volumes of materials to produce the asphaltic composition.

3. The method of claim 1 wherein the first volume of material is virgin aggregate material and the second volume of material is recycle asphalt material.

4. The method of claim 1 wherein the first volume of material is virgin aggregate material and the second volume of material is virgin aggregate material.

5. The method of claim 1 including the step of circulating the gases exiting the second end of the rotating drum into the flame.

6. In a method for continuously producing an asphaltic composition comprising the steps of:

introducing a first volume of material into an inclined, rotating first drum at a first end to flow generally from the first end to a second end of the first drum;

creating a flame at an intermediate location within the first drum and directing a first stream of hot gases produced thereby to flow towards the first end of the first drum in countercurrent relation to the first volume of material for heating the first volume of material;

supporting a second inclined, horizontally rotating drum within the first drum such that an annulus is created between the first drum and the second drum, the second drum having a first end and a second end, and wherein the first end of the second drum is adjacent the flame and the second end of the second drum is adjacent to the second end of the first drum;

generating a second stream of hot gases and a third stream of hot gases;

introducing a second volume of material into the second drum to flow generally the length thereof;

heating the second volume of material within the second drum with the thirdstream of hot gases;

mixing the heated first volume of material with the heated second volume of material within the annulus;

heating the mixing materials within the annulus with the second stream of hot gases; and discharging the asphaltic composition from the annulus.

7. The method of claim 6 including the step of mixing liquid asphalt with the heated first volume of material and the heated second volume of material within the annulus to produce the asphaltic composition.

8. The method of claim 6 wherein the first volume of material is virgin aggregate material and the second volume of material is recycle material.

9. The method of claim 6 wherein the first volume of material is virgin aggregate material and the second volume of material is virgin aggregate material.

10. The method of claim 6 wherein the second and third streams of hot gases are generated by the flame.

11. The method of claim 6 wherein the second stream of hot gas and the third stream of hot gas form a continuous stream of hot gas.

12. The method of claim 6 wherein the third stream of hot gas flows parallel to the flow of the second volume of material.

13. The method of claim 6 wherein the second stream of hot gas flows parallel to the flow of the mixing first and second volumes of materials.

14. The method of claim 6 wherein the second volume of material is introduced into the second drum at the second end thereof to flow generally from the second end to the first end thereof, and wherein the flow of the second volume of material is parallel to the flow of the third stream of hot gases.

15. The method of claim 6 wherein the mixing first and second volumes of materials flow generally within the annulus from the first end of the second drum to the second end of the first drum, and wherein the flow of the mixing first and second volumes of materials is parallel to the flow of the second stream of hot gases.

16. An apparatus for producing an asphaltic composition comprising:

a rotatable drum having a first end and a second end;

means for generating a first stream of hot gases at an intermediate position within the rotatable drum, wherein the first stream of hot gases is directed towards the first end of the rotatable drum;

means for generating a second stream of hot gases at the intermediate position within the rotatable drum, wherein the second stream of hot gases is directed towards the second end of the rotatable drum;

means for introducing a first volume of material into the rotatable drum at the first end thereof, wherein the first volume of material is exposed to the first stream of hot gases, and wherein the first volume of material travels countercurrent to the first stream of hot gases;

means for introducing a second volume of material into the rotatable drum between the first stream of hot gases and the second end of the rotatable drum, wherein the second volume of material travels parallel to the second stream of hot gases;

means for mixing the first volume of material and the second volume of material in the second stream of hot gases; and means for discharging the mixture of the first volume of material and second volume of material at the second end of the rotatable drum.

17. The apparatus of claim 16 further comprising means for introducing liquid asphalt into the mixing first and second materials.

18. The apparatus of claim 16 wherein the means for generating the first stream of hot gases includes means for creating a flame within the rotatable drum between the first end and the second end thereof.

19. The apparatus of claim wherein the means for generating a second stream of hot gases includes a combustion gas circulation means for creating an area of reduced pressure in the rotating drum between the first stream of hot gases and the second end of the rotating drum such that a portion of the hot gases exiting the burner is drawn into the area of reduced pressure and directed towards the second end of the rotating drum.

20. The apparatus of claim 16 wherein the first volume of material is virgin aggregate and the second volume of material is recycle asphalt.

21. The apparatus of claim 16 wherein the first volume of material is virgin aggregate and the second volume of material is virgin aggregate.

22. The apparatus of claim 16 further comprising means for generating a third stream of hot gases at the second end of the rotatable drum.

23. The apparatus of claim 22 further comprising means for circulating the third stream of hot gases into the means for generating a second stream of hot gases.

24. The apparatus of claim 23 wherein the means for generating a second stream of hot gases includes means for creating a flame within the rotatable drum between the first end and the second end thereof.

25. The apparatus of claim 23 wherein the means for generating a third stream of hot gases at the second end of the rotatable drum includes means for reversing the directional flow of the second stream of hot gases exiting the rotatable drum at the second end thereof.

26. An apparatus for producing an asphaltic composition comprising:

a first rotatable drum having a first end and a second end;

a second rotatable drum having a first end and a second end, wherein the second rotatable drum, having a smaller diameter than the first rotatable drum, is disposed within the first rotatable drum such that the second end of the first rotatable drum is adjacent the second end of the second rotatable drum and the first end of the second rotatable drum extends into the first rotatable drum, and wherein an annulus is created within the first rotatable drum between the first and second rotatable drums;

means for generating a first stream of hot gases at an intermediate position within the first rotatable drum, wherein the first stream of hot gases is directed towards the first end of the first rotatable drum;

means for generating a second stream of hot gases at the intermediate position within the first rotatable drum, wherein the second stream of hot gases is directed towards the second end of the first rotatable drum;

means for generating a third stream of hot gases at the second end of the second rotatable drum, wherein the third stream of hot gases is directed into the second rotatable drum towards the first end thereof;

means for supplying a first volume of material into the rotatable first drum at the first end thereof, wherein the first volume of material is exposed to the first stream of hot gases, and wherein the first volume of material travels countercurrent to the flow of the first stream of hot gases;

means for supplying a second volume of material into the second rotatable drum at the second end thereof, wherein the second volume of material is exposed to the third stream of hot gases, and wherein the second volume of material travels parallel to the flow of the third stream of hot gases;

means for mixing the first volume of material and the second volume of material in the annulus, wherein the first volume and the second volume of materials are exposed to the second stream of hot gases, and wherein the first volume and the second volume of materials travel parallel to the flow of the second stream of hot gases; and means for discharging the mixture of the first volume of material and the second volume of material at the second end of the first rotatable drum.

27. The apparatus of claim 26 further comprising means for introducing liquid asphalt into the annulus.

28. The apparatus of claim 26 wherein the means for generating a first stream of hot gases include means for creating a flame within the first rotatable drum adjacent the first end of the second rotatable drum.

29. The apparatus of claim 26 wherein the means for generating a second stream of hot gases includes a combustion gas circulation system, wherein the combustion gas circulation system generates an area of reduced pressure in the annulus such that a portion of the hot gases exiting the burner is drawn into the annulus and directed towards the second end of the first rotatable drum.

30. The apparatus of claim 26 wherein the means for generating a third stream of hot gases includes means for reversing the flow of the second stream of hot gases through the combustion gas circulation system and directing the reversed flow of hot gases into the second rotatable drum.

31. The apparatus of claim 26 wherein the first volume of material is virgin aggregate and the second volume of material in recycle asphalt.

32. The apparatus of claim 26 wherein the first volume of material is virgin aggregate and the second volume of material is virgin aggregate.

* * * * *

UNITED STATES PATENT AND TRADEMARK OFFICE

CERTIFICATE OF CORRECTION

PATENT NO. : 4,913,552

DATED : April 3, 1990

INVENTOR(S) : Paul E. Bracegirdle

It is certified that error appears in the above-identified patent and that said Letters Patent is hereby corrected as shown below:

Column 5, line 28, "24" should be --24C--.

Column 8, line 11, after "claim" insert --16--

Signed and Sealed this

First Day of October, 1991

*Attest:*

*Attesting Officer*

HARRY F. MANBECK, JR.

*Commissioner of Patents and Trademarks*